United States Patent [19]

McNally

[11] 4,098,385

[45] Jul. 4, 1978

[54] CONVERTIBLE COIN SLIDE APPARATUS

[75] Inventor: William J. McNally, Newton, Iowa

[73] Assignee: The Maytag Company, Newton, Iowa

[21] Appl. No.: 763,049

[22] Filed: Jan. 27, 1977

[51] Int. Cl.[2] ..... G07F 5/08

[52] U.S. Cl. ..... 194/55

[58] Field of Search ..... 194/92, 55, DIG. 2, 194/1 G, 57, 58, 2, 54

[56] References Cited

U.S. PATENT DOCUMENTS

| | | | |
|---|---|---|---|
| 3,265,177 | 8/1966 | Knickerbocker | 194/54 |
| 3,712,440 | 1/1973 | Greenwald | 194/55 |
| 3,978,960 | 9/1976 | Mellinger et al. | 194/55 |

*Primary Examiner*—Stanley H. Tollberg
*Attorney, Agent, or Firm*—Richard L. Ward

[57] ABSTRACT

A coin slide apparatus which includes a housing for mounting the apparatus to the machine, a coin slide assembly, a guideway in the housing for the coin slide assembly to operate within, and coin authenticating apparatus on the housing. The coin slide assembly is reciprocally operable in the guideway from an extended coin receiving position through coin measuring and coin ejection positions to a position for initiating operation of the machine. The movable slide assembly comprises three main members: an upper slide plate, a center body portion, and a latch plate. The upper slide plate is formed to include the operating handle at one end and has coin receiving slots of a predetermined size. The center body portion gives the slide assembly the necessary thickness to support coins on edge and serves as a storage area for blanking members and coin inserts which are used to convert the apparatus from one combination of coins to another. The latch plate mates with latch arms, which are mounted on the housing, to prevent operation either without coins or with spurious coins. A bridge portion mounts a plurality of abutments, one above each latch arm, which cooperate with a cam on each latch arm to provide a predetermined coin measuring space therebetween. At least one of the abutments forms part of a preadjustable abutment assembly. When the preadjustable abutment assembly is moved vertically in combination with movement of the coin insert, the coin slot and the predetermined coin measuring space are converted from one denomination to another.

14 Claims, 8 Drawing Figures

CONVERTIBLE COIN SLIDE APPARATUS

BACKGROUND OF THE INVENTION

1. Field of the Invention

This invention relates to the field of coin actuated machines and more particularly to a convertible coin slide apparatus therefor.

2. Description of the Prior Art

Prior coin slide art shows a continuing search for coin slide apparatus operable with varying combinations of coins. U.S. Pat. No. 3,602,352, for example, discloses a system operable with a plurality of vertical coins that utilizes blanking plates to simulate genuine coins and thereby actuate the measuring device with less than the maximum number of coins. U.S. Pat. No. 3,712,440 is similar and discloses the use of blanking members to close the coin slots but requires adjustment of a latching dog to remove the latching dog from the system. Further, in U.S. Pat. No. 3,732,962 the apparatus is operable with a plurality of coins but various caliper blocks and stop blocks must be changed to accommodate different combinations of coins. All of these systems require a relatively large degree of mechanical manipulation to accomplish the desired conversion from one combination of coins to another and none of these systems include any means for storing the required conversion members within the slide itself.

SUMMARY OF THE INVENTION

It is an object of the instant invention to provide an improved convertible coin slide apparatus.

It is a further object of the instant invention to provide a coin slide apparatus wherein the coin slide assembly is easily disassembled and converted from one combination of coins to another combination.

It is a still further object of the instant invention to provide a coin slide apparatus having selectively positionable coin measuring devices for changing from one actuating combination of coins to another.

Briefly, the instant invention achieves these objects in a coin slide apparatus that includes a housing and associated mounting means in combination with a reciprocal coin slide assembly. The coin slide apparatus further has various coin measuring devices including a cam and selectively positionable abutment arrangement to provide a coin slide apparatus operable over a range of coin combinations.

Operation of the apparatus and further objects and advantages thereof will become evident as the description proceeds and from an examination of the accompanying three pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
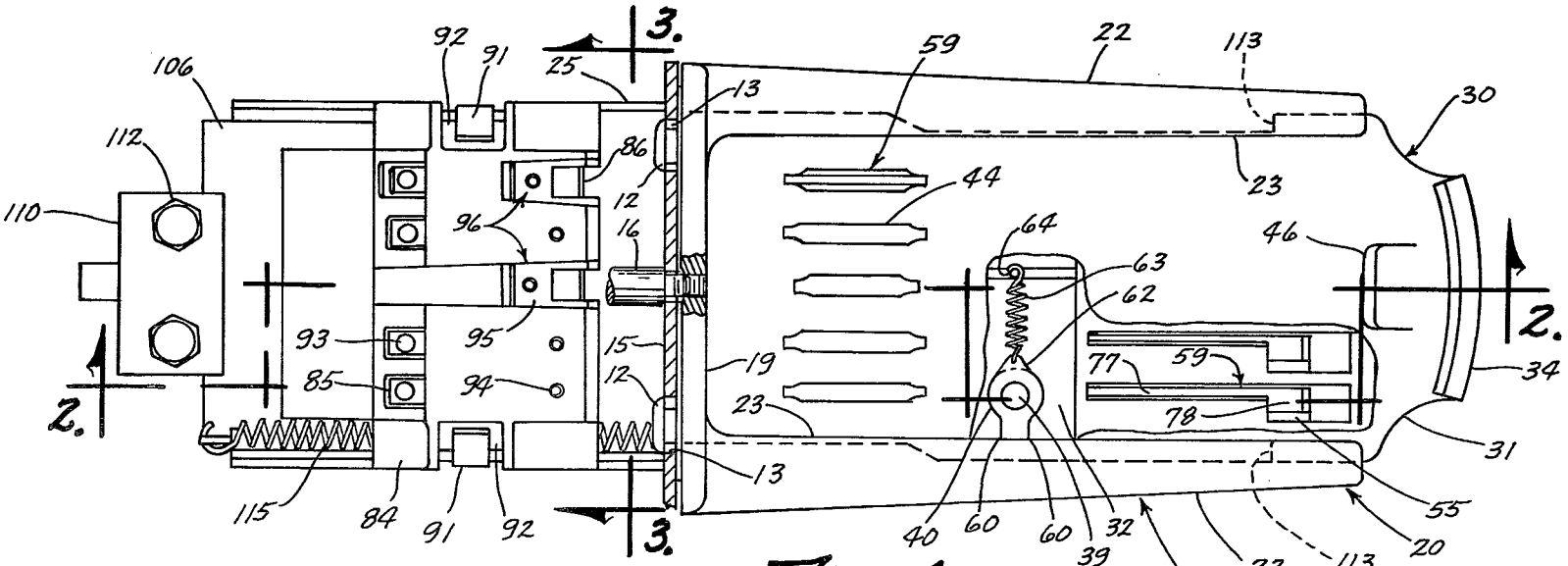
FIG. 1 is a plan view of the coin slide apparatus with a portion broken away to show the blanking members in storage.
Figure 2:
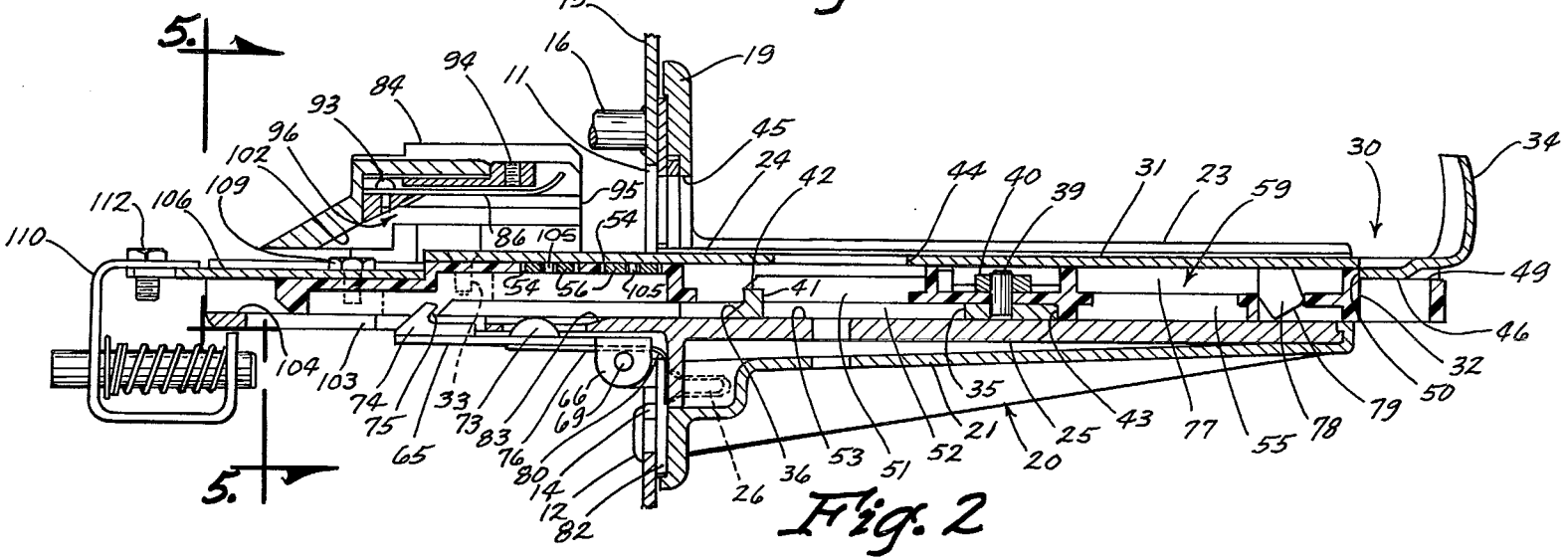
FIG. 2 is a sectional view taken along lines 2—2 of FIG. 1, showing interior construction detail along a coin slot.
Figure 7:
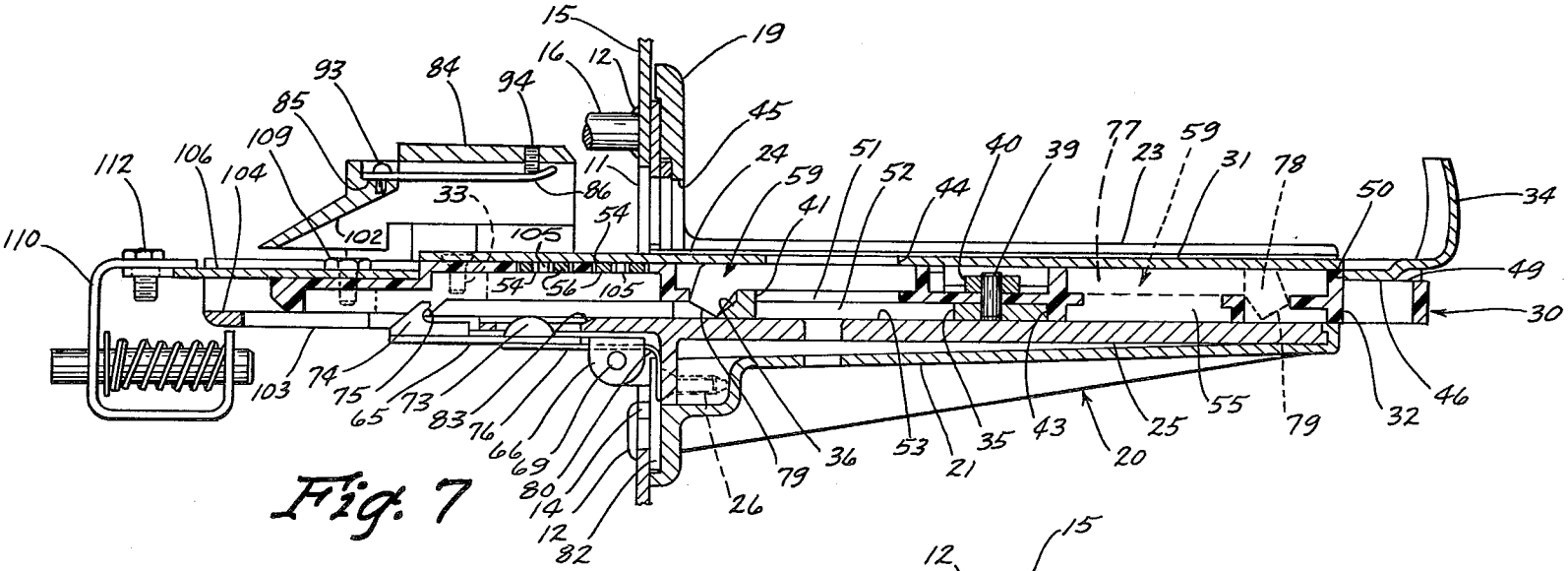
FIG. 7 is a view similar to FIG. 2 showing a permanent abutment assembly and a blanking member in operative position.
Figure 8:
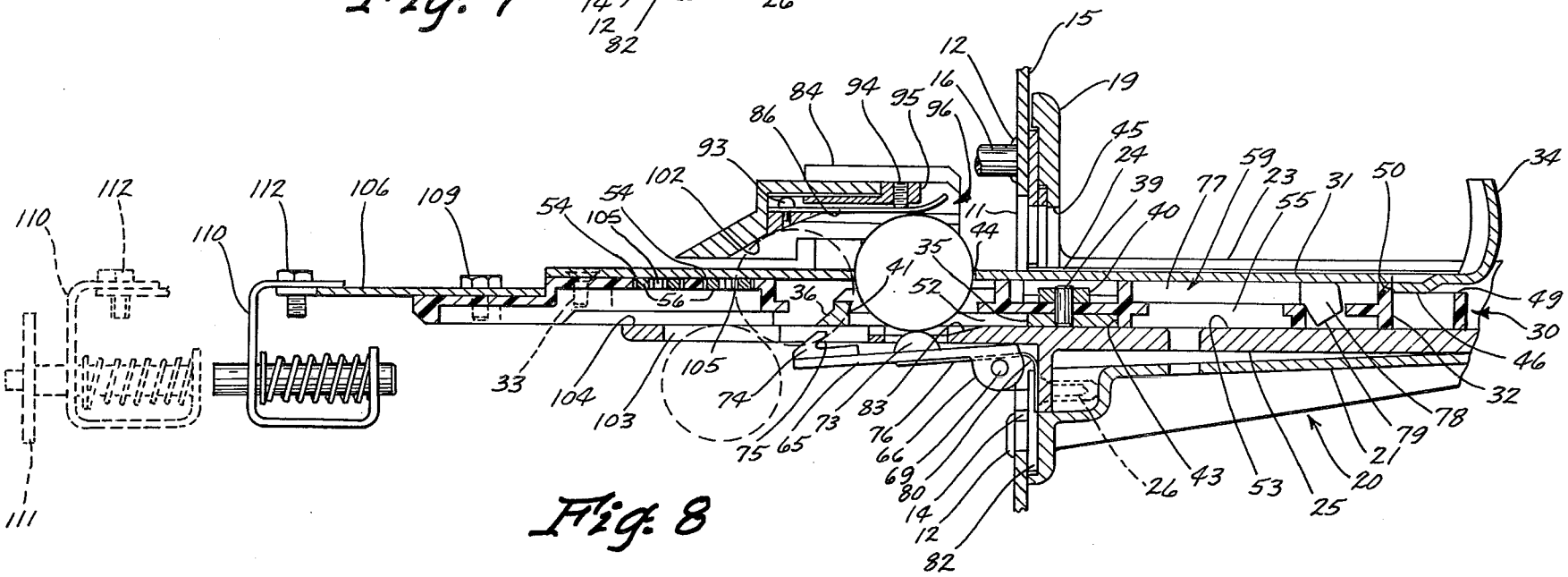
FIG. 8 is a view showing a proper coin advancing through the coin ejection position and leaving the coin slide. Also shown in dashed lines is the end of a fully extended coin slide in the operative position.

Referring to the drawings there is shown generally in FIG. 1 and further in the additional drawings a coin slide apparatus 10 so constructed as to be mounted in a standard coin slide vault panel opening 11, as in FIGS. 2, 7 and 8, and thereby supported on a machine which is to be actuated by such a coin slide apparatus 10.

Mounting of the coin slide apparatus 10 in the panel opening 11 is accomplished by sliding the apparatus 10 into the opening 11 and allowing the shouldered screws 12 to pass through clearance holes 13 at the top and clearance slots 14 at the bottom of the opening 11. The shoulder of the screws 12 allows the apparatus 10 to grip the vault wall 15. Final securing of the apparatus 10 is accomplished from within the vault by tightening a threaded rod 16 into a faceplate portion 19 of the coin slide apparatus 10 which draws the apparatus 10 snugly against the vault wall 15.

The coin slide apparatus 10 includes a forwardly extending housing support 20 and the faceplate portion 19 cast as a unitary member. The forwardly extending housing support 20 includes a base 21 and a pair of opposed sidewalls 22 having inwardly extending flanges 23, as shown in FIG. 1, to define a rearwardly extending longitudinal channel 24 through the faceplate 19. In the drawings, a forward direction is to the right and a rearward direction is to the left.

Figure 3:
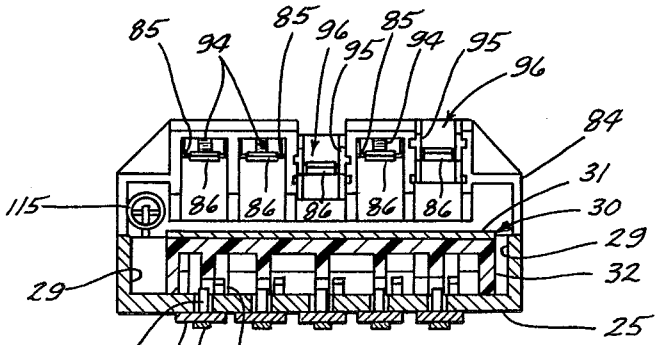
FIG. 3 is a section taken along lines 3—3 of FIG. 1 looking into the coin measuring area.

Assembled into the longitudinal channel 24 from the rear of the faceplate 19 is a slide housing 25, as shown in FIG. 2. The slide housing 25 is connected to the combination faceplate-housing support by a pair of threaded fasteners 26. The slide housing 25 includes a short upwardly extending wall 29 at each side, as shown in FIG. 3, which cooperates with the flange 23 on the channels of the housing support 20 to provide a guideway for a horizontally reciprocal slide assembly 30.

The reciprocally movable slide assembly 30 includes an upper slide plate 31 which is fixed to a center slide plate or center body portion 32 by a pair of screws 33. The upper slide plate 31 also includes an upturned handle 34, at the end opposite the screws 33, for operation of the slide assembly 30 within the guideway defined by the inwardly extending flanges 23 and upwardly extending walls 29. The center body 32 is formed to receive a latch plate 35 as shown in FIG. 2. The latch plate 35 is hardened and has a beveled leading edge 36 and a stud-like projection 39 which extends through the center body 32 to provide a pivot support for a ratchet pawl 40 which will be further defined. Immediately adjacent the beveled leading edge 36 of the latch plate 35 is a ribbed section 41 that extends transversely across the latch plate 35 as in FIG. 2. This rib section 41 mates with a transverse groove 42 in the body portion 32 of the slide assembly 30 to locate the forward edge of the latch plate 35. The rear of the latch plate 35 is maintained in position by a downwardly extending wall 43 in the body portion 32. These features, cooperating with the guideway, serve to retain the latch plate 35 as part of the slide assembly 30.

The general construction of the coin slide as hereinabove described is also disclosed in the following United States patents assigned to the assignee of the instant invention:

| Patent No. | Date | Patentee |
|---|---|---|
| U.S. 3,977,506 | August 31, 1976 | McNally |
| U.S. 3,978,960 | September 7, 1976 | Mellinger et al |

The upper slide plate 31 includes coin slots 44 which are sized to receive coins having particular denominations including, in this embodiment, four slots for quarters and one slot for a nickel. The slots 44 in the upper slide plate 31 are aligned with vertical passageways 45, see FIG. 2, in the faceplate 19 which permit the passage of coins that are positioned in the coin slots 44 and which partially extend above the surface of the upper slide plate 31. Though five slots 44 are shown in the upper slide plate 31, means are provided for blanking off up to four slots 44 as will be shown and discussed hereinbelow.

The coin slots 44 are shaped, as shown in FIG. 1, to approximate a particular coin's maximum permissible thickness and diameter at each end but are substantially wider at the center to accommodate a coin which may be of the proper denomination but slightly deformed in the center. These slots 44 perform a preliminary measuring of a coin's diameter and thickness. The upper slide plate 31 also includes a rectangular detent 46 as shown in FIGS. 1 and 2. This detent 46 rests in a notch 49 at the front of the center body 32 with the deepest portion of the detent 46 contacting the wall 50 of the notch 49.

As shown in FIG. 2, the center body 32 provides substantial thickness to the slide assembly 30 as compared to the thickness of the upper slide plate 31, and thus a significant portion of the coin diameter is below the surface of the upper slide plate 31 when the coin is of proper diameter. The center body portion 32 is molded from a thermoplastic material and includes a first transverse row of coin receiving pockets 51 below and substantially aligned with the slots 44 in the upper plate 31 but these coin receiving pockets 51 are of uniform size rather than of a size that corresponds to the size of the juxtaposed slot 44 in the upper slide plate 31. The latch plate 35 includes elongated openings 52 aligned with the slots 44 in the upper slide plate 31 and the first pockets 51 in the center body portion 32, as shown in FIG. 2, to allow the lower edge of inserted coins to rest on the surface of the guideway 53 of the slide housing 25.

Figure 6:
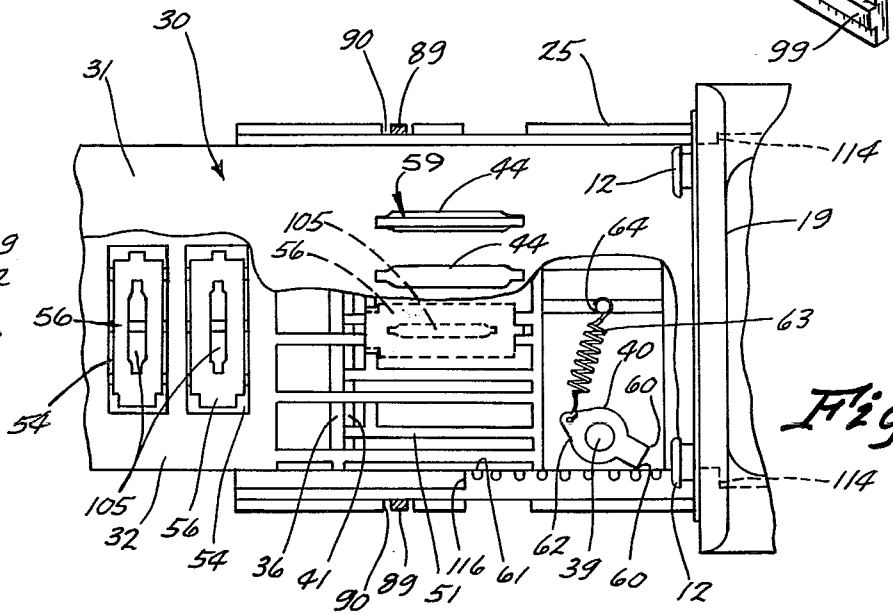
FIG. 6 is a fragmentary section showing the slide partially advanced and showing coin inserts in an operative position and in storage.

The center body 32 further includes a second and third row of pockets or recesses 54 and 55, as shown in FIGS. 1 and 6, to receive in storage a plurality of coin inserts 56 and blanking members 59, respectively. As shown in FIG. 6, the second row of pockets 54 are rectangular in shape and are located rearwardly from the first row of pockets 51. As shown in FIG. 1, the third row of pockets 55 for storage of the blanking members 59 are located forward of the first row of pockets 51.

The center body 32 supports a ratchet mechanism, as shown in FIGS. 1 and 6, where the pawl 40 is pivotally mounted on the projecting stud 39 of the latch plate 35. The ratchet pawl 40 is a hardened metal part having a center pivot with a generally rectangular shape at one end defining two sharp edges 60 for engagement with ratchet teeth 61 on either the forward or return stroke of the slide assembly 30 and a tapered opposite end 62 for attaching a pawl biasing member 63. The pawl biasing member 63 is connected between a molded peg 64 on the center body 32 and the trailing tapered end 62 of the ratchet pawl 40. The tooth portion 61 of the ratchet mechanism is cast into a sidewall of the slide housing 25 as shown in FIG. 6 and is operable for engagement with the ratchet pawl 40. Once the coin passes through the coin measuring area, the ratchet pawl 40 engages with a ratchet tooth 61 as shown in FIG. 6 thus requiring the slide assembly 30 to be advanced past the remaining ratchet teeth 61. Once the slide assembly 30 and ratchet pawl 40 have been advanced past the ratchet teeth 61 to the operative position, as shown in dashed lines in FIG. 8, the ratchet pawl 40 will reverse and the ratchet teeth 61 will engage a reverse direction during withdrawal of the slide assembly 30 so that the slide assembly 30 cannot be returned to the operative position before returning to the coin receiving position. The ratchet mechanism thus functions to require a complete slide assembly 30 reciprocation once an actuation has been effected so that coins cannot be returned rather than being ejected into a coin receptacle within the vault.

Figure 4:
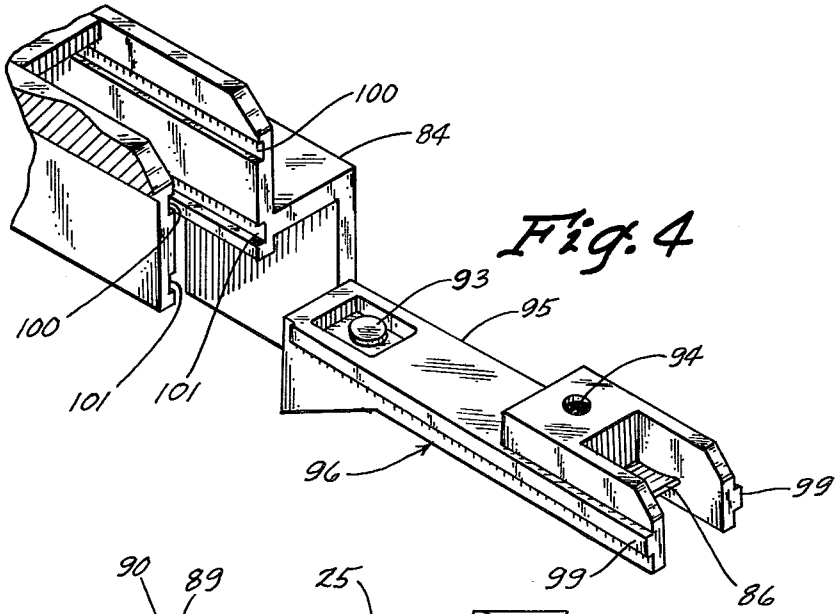
FIG. 4 is an enlarged perspective view showing an abutment mounting block and the bridge portion which receives this mounting block.
Figure 5:
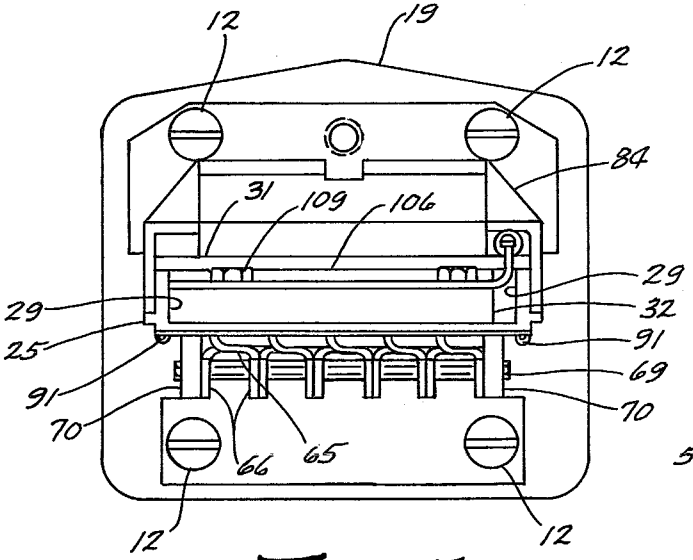
FIG. 5 is an end view taken generally along lines 5—5 of FIG. 2 shown without the vault panel.

Pivotally mounted to the assembly of the housing support 20 and the slide housing 25 are a plurality of latch arms 65, with one generally aligned with each of the vertical passageways 45 in the slide housing 25, as shown in FIG. 2. These latch arms 65 are individually pivoted by a pair of downwardly turned ears 66 supported on a horizontal pin 69 which is in turn supported by two depending tabs 70 on the slide housing 25, FIG. 5. Each latch arm 65 includes, at a position intermediate the pivot end and the free end, an upwardly extending, semicircular, cam surface 73 engageable with the edge of an inserted coin. Each latch arm 65 also includes at its free end a pawl 74 laterally offset from the coin cam 73 center line and having a reverse inclined face 75 engageable with the hardened beveled leading edge 36 of the latch plate 35 when the pawl 74 is in a first posture as shown in FIGS. 2 and 7 under the biasing of a leaf spring 76. Forwardly adjacent the inclined face 75, the edge of the pawl 74 is beveled for engaging with the ramp portion 79 of a blanking member 59 to be described hereinbelow. A one-piece spring assembly 80 having a plurality of leaf springs 76 is formed from a flat sheet of spring stock. The individual leaf springs 76 are bent at right angles to the remaining rectangular sheet so that they extend rearwardly under each latch arm 65, as best shown in FIG. 3, to upwardly bias each arm 65. The remaining rectangular base portion of the spring assembly is retained by the slide housing 25 through a flat rectangular plate 82 and a pair of shouldered mounting screws 12, as shown in FIGS. 2 and 4.

Also included in the surface of the guideway 53 of the slide housing 25 is a downward sloping ramp 83 which causes the coin or coins to drop by gravity from a first higher elevation to a second lower elevation prior to measuring. This change in elevation from higher to lower is provided so that if an object other than a coin is wedged into the coin slot 44 the object will not cam the latch arm 65 down since the object will be wedged at the first higher elevation and will therefore be too high to engage the cam 73. The provision that the coin drop by gravity from a higher to a lower elevation requires that the coin be free, whereas, if the coin were being elevated from a lower level to a higher level a spurious coin could be wedged into the slot 44 and be forced into the coin measuring area. The feature of a downward sloping ramp 83 is also disclosed in and is claimed in U.S. Pat. No. 3,978,960 entitled "Coin Authenticating Slide Mechanism" and assigned to the assignee of the instant invention.

Significant coin authentication is effected by a measuring system including the cam surface 73 of the latch arm 65. Behind the faceplate 19 is a bridge 84, having at different heights, supports 85 for flat fingerlike abutments 86 which are engageable with a coin diameter. The bridge 84 is located on the slide housing 25 as in FIG. 1 by means of tabs 89 on the lower edges of the bridge 84 and mating slots 90 on the edge of the slide housing 25 as shown in FIG. 6. The bridge 84 is secured to the slide housing 25 with two snap flat springs 91, as shown in FIG. 1, which hook under the slide housing 25, as in FIG. 5, and snap into a recess 92 on each side of the bridge 84. The bridge 84 is thus restrained from movement and disassembly is simple.

As best shown in FIGS. 1 and 3, the first, second and fourth abutments 86, when numbered from the left in FIG. 3, are disposed above the coin cam 73 of a latch arm 65 with one end secured to the bridge 84 by a rivet 93 and the opposite end positioned by a setscrew 94 as shown by the cross section view of FIG. 7. The position of one end of the abutment 86 is adjustable in small increments with the setscrew 94 so that the predetermined spacing between the abutment 86 and the coin cam 73 is such as to pivot the latch pawl 74 downward into a second posture for non-engagement with the latch plate 35 in the presence of a proper coin diameter.

As shown in FIG. 3, the third and fifth abutments 86 are mounted in separate abutment mounting blocks 95 which in turn are mounted on the bridge 84. The abutments 86 are secured to these mounting blocks 95 in the same manner as the first, second and fourth abutments 86 are secured to the bridge 84. When the abutments 86 have been secured to the abutment mounting blocks 95 and the setscrews 94 have been adjusted to a predetermined dimension, the entire assembly is termed a preadjusted abutment assembly 96. As best shown in FIGS. 3 and 4, the mounting blocks 95 include substantially rectangular rib portions 99 on each side which extend longitudinally from front to rear and mate with either a first upper set of grooves 100 or a second lower set of grooves 101 in the bridge 84. The ribs 99 and grooves 100 and 101 are so designed that when the mounting block ribs 99 are inserted into the grooves 100 or 101, a very slight interference fit results which prevents the mounting block 95 from becoming accidentally disengaged from the bridge 84. The preadjusted abutment assemblies 96 are identical for both the third and fifth abutment locations and are preadjusted so that when inserted into the second lower set of grooves 101 in either location, the predetermined coin space will accommodate a dime. When placed in the first upper set of grooves 100 in the third and fifth abutment locations, the predetermined space will accommodate a nickel and a quarter, respectively. The setscrews 94 allow readjustment, if necessary, of the preadjusted abutment assembly 96 after mounted on the bridge 84.

The ramp portion 102 of the bridge 84 immediately rearward of the coin measuring area is sloped downward and rearward, as shown in FIGS. 2 and 8, to impart a downward thrust to the coin as it is ejected from the coin slide assembly 30 through a port 103 in the slide housing 25. The combination of the ramp 102 and a stripper bar 104 at the end of the port 103 in the slide housing 25 serves to strip any coin from the slide assembly 30 which may have been taped or otherwise held to the slide assembly 30 in a spurious attempt to retrieve the coin after actuation.

The second row of pockets 54 located just to the rear of the first pockets 51 in the center body portion 32 as best shown in FIG. 6 are sized to receive and store rectangular coin inserts 56. Two of these coin inserts 56 are provided and are movable from the second row of pockets 54 to either the third or fifth pocket of the first row of pockets 51 in coordination with the movement of the preadjusted abutment assemblies 96 from the first upper grooves 100 to the second lower grooves 101. Each coin insert 56 is generally rectangular in shape with different size tabs at each end, as shown in FIG. 6, for longitudinally orienting the insert in the first pocket 51. Also, each coin insert 56 has a coin slot 105 corresponding to the physical size of a dime coin for supporting the dime coin in a vertical position in the coin slide assembly 30.

As previously indicated, up to four of the five coin slots 44 may be blocked off so that the indicated coin is not required and in fact cannot be inserted into the coin slot 44 of the upper slide plate 31. Stored within the third row of pockets or recesses 55, as shown in FIGS. 1 and 2, are coin-blanking members 59 which are fabricated from a nonmagnetic material and include an elongated body portion 77 and a head portion 78 having a ramp 79 on the underside for engaging with the beveled edge of the latch arm pawl 74 and camming the arm 65 downward into the previously mentioned second posture for nonengagement with the latch plate 35.

To remove the upper slide plate 31 for conversion of the coin slide apparatus 10 from one combination of coins to another, the slide assembly 30 is moved partially inward to expose the two mounting screws 33. By removing these two screws 33, the upper slide plate 31 may be removed by sliding it forward through the faceplate 19 and away from the center plate 32 of the slide assembly 30 to expose the coin inserts 56 disposed in the second row of pockets 54 and the blanking members 59 in the third row of pockets 55, as shown in FIGS. 6 and 7, without disassembly of other parts. If it is desired to eliminate the requirement for a coin in a particular slot 44, the blanking members 59 may then be removed from the third row of storage pockets or recesses 55 and placed in the first coin receiving pockets 51 so that the elongated body portion 77 will underlie the coin slot 44 in the upper slide plate 31 and the head portion 78 will extend downwardly to a position juxtaposed and to the left of the leading edge of the latch plate 36 as in FIG. 7. When the blanking members 59 are in a slot blanking position as shown by the unbroken line in FIG. 7, a coin cannot be inserted into the coin slot 44 of the upper slide plate 31, and as the slide assembly 30 is advanced to the coin measuring area, the ramp 79 on the underside of the head 78 operates to engage the latch pawl 74 and to depress it to a position below the lower surface of the latch plate 35 to thus obviate the need for a coin in the particular slot 44.

If it is desired to change either or both of the denominations of the coins in the third or fifth positions from a nickel and a quarter respectively to a dime, the coin inserts 56 may be moved from the second pockets 54 to either the third or fifth pockets of the first row of pockets 51 and the preadjusted abutment assemblies 96 may be moved from the first upper set of grooves 100 to the second lower set of grooves 101, as shown in FIGS. 3, 4 and 6. A coin insert 56 is positionable in the third pocket as indicated by the broken lines in FIG. 6. These two changes will convert either position to a dime coin.

With the proper manipulation, the coin receiving slots 55 may thus be selectively blocked off or converted in denomination so that the slide apparatus 10 is adapted to receive and actuate with any five cent increment between a coin value of five cents to one dollar and ten cents.

The slide assembly 30 is adapted to receive an actuator mounting bracket 106 secured by fasteners 109 as shown in FIG. 2. Similarly, an actuator assembly 110, which is operable for actuating the timer or other control device 111 to initiate operation of the machine, is attached to the mounting bracket 106 by a pair of threaded members 112.

For purposes of discussing operation of the coin slide apparatus 10 with a proper coin it is assumed that a blanking member 59 has been operatively disposed of all of the coin slot 44 positions except the nickel slot through which the section of FIG. 2 is taken. After an authentic nickel is inserted in the slot 44, and enters the slot 44 with the lower edge resting on the surface of the slide housing guideway 53, the slide assembly 30 is advanced to carry the coin toward the faceplate 19 and through the vertical passageway 45 therein. Continued advancement of the slide assembly 30 moves the coin to the coin measuring area as in FIG. 8. During this advancement the coin is moved down the ramp 83 formed in the slide housing 25 to the semicircular coin cam 73. With the bottom edge of the coin engaging the coin cam 73 and the upper edge engaging the abutment 86, the latch arm 65 is pivoted downwardly by the advancing coin to position the latch pawl 74 below the plane of the latch plate 35. Engagement of the ramp portion 79 of the blanking members 59 with the remaining latch pawls 74, as the slide assembly 30 is advanced, enables the remaining latch pawls 74 to be similarly positioned below the plane of the latch plate 35. The slide assembly 30 is thus free to continue advancement through the coin ejection position, where the ramp portion 102 of the bridge 84 starts the coin downward through a port 103 in the slide housing 25, as shown by broken lines in FIG. 8, to the operative position. At the end of the actuation stroke of the slide assembly 30, the actuator assembly 110 engages and effects operation of a timer or control device 111. When the slide assembly 30 has reached this operative position, it is prevented from further travel by the engagement of the stops 113 on the center body 32 with a mating forward land 114 on each upwardly extending wall 29 of the slide housing 25 as shown in FIGS. 1 and 6. Upon completion of the inward actuation stroke of the slide assembly 30, the assembly 30 is returned to the coin receiving position by a return spring 115 mounted between the side of the actuator mounting bracket 106 and the retainer plate as shown in FIG. 1. The return stroke is limited by the engagement of the actuator mounting bracket 106 with a rearward land 116 as shown in FIG. 6.

To achieve the indicated combinations of coins ranging from 5 cents to 1 dollar and 10 cents in 5 cent increments it is necessary to use the coin inserts 56 and the blanking members 59 in combination. The 5 cent minimum, for example, is achieved by using blanking members 59 on all of the quarter positions. An intermediate amount such as 45 cents is had by using blanking members 59 in two of the three permanent abutment quarter slots and the coin inserts 56 in both adjustable slots. The 1 dollar and 10 cent maximum is accomplished by using a coin insert 56 in the nickel slot and moving the corresponding abutment assembly 96 from the first upper set of grooves 100 to the second lower set of grooves 101.

The present construction thus provides an improved coin slide apparatus 10 offering fast, convenient conversion from one combination of coins to another. The coin slide apparatus 10 offers the capability of either completely blanking any coin slot 44 or changing the denomination of selected slots from one predetermined denomination to another predetermined denomination. The construction offers a unique convertible coin slide apparatus 10 having improved operational characteristics while providing for storage of conversion pieces 56 and 59.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A convertible coin slide apparatus, comprising: housing means for mounting said apparatus on a controlled appliance; a coin slide assembly defining at least one coin slot having predetermined dimensional characteristics for receiving a coin of a first predetermined denomination and effecting a preliminary coin measurement, said coin slide assembly being supported in said housing means for reciprocal movement between a coin receiving position and an appliance actuating position; slot modifying means for effectively altering the dimensional characteristics of said coin slot to effect a preliminary measurement of a coin of a second predetermined denomination; and coin authenticating means associated with said housing means and said slide assembly and including an abutment means supported in a first position on said housing means and engageable by said coin of said first denomination, said authenticating means further including cam means movably supported on said housing means in operative alignment with and spaced a first predetermined dimension from said abutment means to receive a coin of said first predetermined denomination therebetween, said cam means being movable from a first posture to a second posture responsive to said coin of said first predetermined denomination for permitting movement of said slide assmbly to said actuating position, said abutment means being disconnectable from said first position and movable to a second position on said housing means to change said first predetermined dimension to a second predetermined dimension for receipt of said coin of said second predetermined denomination between said abutment means and said cam means.

2. A coin slide apparatus as defined in claim 1 wherein said disconnectable abutment means further comprises an abutment assembly including an abutment member and an abutment mounting block for mounting said abutment member, said abutment mounting block being engageable with said housing means for selectively positioning said abutment member at said first or second positions.

3. A coin slide apparatus as defined in claim 2 wherein said abutment mounting block includes longitudinal rib portions and said housing means includes grooves for receiving said rib portions of said abutment mounting block to position said abutment member at said first and second positions.

4. A coin slide apparatus convertible from one actuating combination of coins to another, comprising: housing means for mounting said apparatus on a controlled appliance; a coin slide assembly defining a plurality of coin slots for receiving coins on edge and supported in said housing means for reciprocal movement between a coin receiving position and an appliance actuating position; coin authenticating means associated with said coin slots including an abutment means and associated cam means for receiving a coin therebetween, at least one of said abutment means comprising an abutment assembly disconnectably supported in a first position on said housing means, said disconnectable abutment assembly including an abutment mounting block and an abutment member mounted thereon, one of said cam means being pivotally supported on said housing means in operative alignment with and spaced a predetermined dimension from said abutment member in said first position to receive a coin of predetermined denomination therebetween, each of said cam means being operable in a first posture for preventing movement of said slide assembly to said appliance actuating position and movable from said first posture to a second posture for unlatching said slide assembly responsive to said coin of predetermined denomination whereby movement of said slide assembly to said actuating position is permitted when all of said cam means are moved to said second posture, said disconnectable abutment assembly being removable from said first position and movable to a second position on said housing means to change the predetermined dimension between said one cam means and said one abutment member to operably receive a coin of different denomination therebetween; and at least one coin insert storable in said coin slide assembly and movable to a position generally below one of said coin slots coincident with the movement of said one abutment assembly from said first position to said second position, said coin insert defining a smaller coin slot for receiving and for vertically supporting said coin of different denomination.

5. A coin slide apparatus as defined in claim 4 including a plurality of slot blanking members storable in said coin slide assembly and individually manually movable to positions subjacent selected ones of said coin slots to effectively close said selected coin slots and to obviate the need for a coin in said coin slots.

6. A coin slide apparatus as defined in claim 5 wherein said slide assembly further includes a body portion having a first, second and third plurality of pockets with said first plurality of pockets substantially below said coin slots for receiving coins on edge and with said second and third plurality of pockets for receiving in storage said coin inserts and said slot blanking members.

7. A coin slide apparatus convertible from one actuating combination of coins to another, comprising: housing means for mounting said apparatus on a controlled appliance; a coin slide assembly defining a plurality of coin slots each sized for receiving on edge a coin of predetermined denomination to effect a preliminary measurement thereof, said coin slide assembly being supported in said housing means for reciprocal movement between a coin receiving position and an applicance actuating position; coin authenticating means associated with said coin slots including an abutment means and associated cam means for receiving a coin therebetween, each of said cam means being pivotally supported on said housing means in operative alignment with and spaced a predetermined dimension from an associated one of said abutment means to receive a coin of predetermined denomination therebetween, each of said cam means being operable in a first posture for preventing movement of said slide assembly to said appliance actuating position and movable from said first posture to a second posture for unlatching said slide assembly responsive to said coin of predetermined denomination whereby movement of said slide assembly to said actuating position is permitted when all of said cam means are moved to said second posture, at least one of said abutment means being disconnectable from said first position and movable to a second position on said housing means to change said predetermined dimension to receive a coin of different denomination between said one abutment means and its associated cam means; and means for modifying the coin slot associated with said one disconnectable abutment means for effectively altering the size of said coin slot to effect a preliminary measurement of said coin of different denomination.

8. A coin slide apparatus as defined in claim 7 wherein said disconnectable abutment means further comprises an abutment assembly including an abutment member and an abutment mounting block for mounting said abutment member, said abutment mounting block being engageable with said housing means for positioning said abutment member at said first or second positions.

9. A coin slide apparatus convertible from one actuating combination of coins to another, comprising: housing means for mounting said coin slide apparatus on a controlled appliance; a coin slide assembly supported on said housing means and reciprocally movable from a coin receiving position to an operative position for activating said controlled appliance, said coin slide assembly including a slide plate and a body portion, said slide plate having a plurality of coin slots of predetermined size for receiving and effecting preliminary measurement of each of said coins; movement control means including a plurality of latch arms pivotally mounted on said housing means and operable in a first posture for preventing movement of said slide assembly to said operative position and individually movable to a second posture for unlatching said slide assembly whereby movement of said slide assembly to said operative position is permitted when all of said latch arms have been moved to said second posture; coin authenticating means including a cam on each of said latch arms and a bridge supporting a plurality of abutments with one abutment positioned above each of said cams to define therebetween a predetermined coin spacing; at least one of said abutments being detachably supported in a first position on said bridge and movable to a second position on said bridge to change said predetermined dimension to operably receive a coin of different denomination, said coin authenticating means further including at least one coin insert for effectively modifying the size of at least one of said coin slots to receive said coin of different denomination, said coin insert being selectively movable from a storage position within said body portion to a position subjacent at least one of said coin slots coincident with the movement of said detachable abutment from said first position to said second position; and at least one slot blanking member storable within said body portion and individually manually movable to positions subjacent selected ones of said coin slots to obviate the need for a coin in said selected coin slots, said blanking member, said detachable abutment and said coin insert being thereby selectively positionable to provide operation of said coin slide apparatus with various combinations of coins.

10. A coin slide apparatus as defined in claim 9 wherein said removably supported abutment includes an abutment assembly including an abutment mounting block and a flat, fingerlike rectangular abutment member rigidly secured at one end to said abutment mounting block with the opposite end of said abutment member being adjustable in a vertical direction to provide fine adjustment of said predetermined dimension.

11. A convertible coin slide apparatus, comprising: housing means for mounting said apparatus on a controlled appliance; a coin slide assembly defining at least one coin slot for receiving a coin on edge and supported in said housing means for reciprocal movement between a coin receiving position and an appliance actuating position; and coin authenticating means associated with said housing means and said slide assembly and including an abutment assembly supported in a first position on said housing means, said abutment assembly comprising an abutment mounting block supporting an abutment member engageable by said coin, said authenticating means further including cam means movably supported on said housing means in operative alignment with and spaced a first predetermined dimension from said abutment member to receive a coin of predetermined denomination therebetween, said cam means being movable from a first posture to a second posture responsive to said coin of predetermined denomination for permitting movement of said slide assembly to said actuating position, said abutment assembly being disconnectable from said first position and movable to a second position on said housing means to change said first predetermined dimension to a second predetermined dimension for receipt of a coin of different denomination between said abutment member and said cam means, said abutment mounting block includes longitudinal rib portions and said housing means includes grooves for receiving said rib portions to position said abutment assembly at said first and second positions.

12. A convertible coin slide apparatus, comprising: housing means for mounting said apparatus on a controlled appliance; a coin slide assembly supported by said housing means for reciprocal movement between a coin receiving position and an appliance actuating position, said coin slide assembly including a first coin slot having predetermined dimensional characteristics for receiving a coin on edge and effecting a preliminary coin measurement; coin authenticating means associated with said housing means and said slide assembly and including an abutment means on said housing means for engagement by said coin and further including latch means movably supported on said housing means in operative alignment with and spaced a first predetermined dimension from said abutment means to receive a coin of predetermined denomination therebetween, said latch means being movable from a first posture to a second posture responsive to said coin of predetermined denomination for permitting movement of said slide assembly to said actuating position, said abutment means being adjustable to change said first predetermined dimension to a second predetermined dimension for receipt of a coin of different denomination between said abutment means and said latch means; and coin slot modifying means defining a second coin slot having different predetermined dimensional characteristics and positionable on said coin slide assembly for receiving and effecting a preliminary measurement of said coin of different denomination.

13. A coin slide apparatus as defined in claim 12 wherein said coin slide assembly includes an upper plate defining said first coin slot and wherein said coin slot modifying means includes an insert member movable to a position juxtaposed to said first coin slot.

14. A convertible coin slide apparatus, comprising: housing means for mounting said apparatus on a controlled appliance; a coin slide assembly defining at least one coin slot for receiving a coin on edge and supported in said housing means for reciprocal movement between a coin receiving position and an appliance actuating position; coin authenticating means associated with said housing means and said slide assembly and including an abutment means supported in a first position on said housing means and engageable by said coin, said authenticating means further including latch means movably supported on said housing means in operative alignment with and spaced a first predetermined dimension from said abutment means to receive a coin of predetermined denomination therebetween, said latch means being movable from a first posture to a second posture responsive to said coin of predetermined denomination for permitting movement of said slide assembly to said actuator position, said abutment means being disconnectable from said first position and movable to a second position on said housing means to change said first predetermined dimension to a second predetermined dimension for receipt of a coin of different denomination between said abutment means and said cam means; and means operable in said first and second positions for effecting fine adjustment of said abutment means to said first and second dimensions respectively.

* * * * *